US010363999B2

(12) United States Patent
Koop et al.

(10) Patent No.: US 10,363,999 B2
(45) Date of Patent: Jul. 30, 2019

(54) ACTIVE ROLL STABILISATION SYSTEM FOR DAMPING A SHIP'S MOTION

(71) Applicant: Quantum Controls B.V., Nuth (NL)

(72) Inventors: Mattheus Theodorus Koop, Tilburg (NL); Lambertus Johannes Maria Dinnissen, Nuth (NL)

(73) Assignee: Quantum Controls B.V., Nuth (NL)

( * ) Notice: Subject to any disclaimer, the term of this patent is extended or adjusted under 35 U.S.C. 154(b) by 0 days.

(21) Appl. No.: 15/747,335

(22) PCT Filed: Jul. 14, 2016

(86) PCT No.: PCT/NL2016/050520
§ 371 (c)(1),
(2) Date: Jan. 24, 2018

(87) PCT Pub. No.: WO2017/018877
PCT Pub. Date: Feb. 2, 2017

(65) Prior Publication Data

US 2018/0215449 A1 Aug. 2, 2018

(30) Foreign Application Priority Data

Jul. 24, 2015 (NL) ..... 2015217

(51) Int. Cl.
*B63B 39/06* (2006.01)
*B63B 39/04* (2006.01)

(52) U.S. Cl.
CPC ..... *B63B 39/06* (2013.01); *B63B 39/04* (2013.01); *B63B 2039/066* (2013.01)

(58) Field of Classification Search
CPC ..... B63B 39/00; B63B 39/06; B63B 39/04; G05D 1/08
(Continued)

(56) References Cited

U.S. PATENT DOCUMENTS 3,687,100 A * 8/1972 Larsh ..... G05D 1/0875 114/126
3,842,777 A * 10/1974 Larsh ..... B63B 39/06 114/126
(Continued)

FOREIGN PATENT DOCUMENTS

EP 1498348 A1 1/2005
EP 2277771 A1 1/2011
(Continued)

OTHER PUBLICATIONS

PCT Written Opinion of the International Searching Authority (PCT/ISA/237) by the ISA European Patent Office dated Feb. 2, 2017 for PCT application No. PCT/NL16/50520 filed Jul. 14, 2016 and published as WO 2017/018877 on Feb. 2, 2017.

*Primary Examiner* — Lars A Olson
(74) *Attorney, Agent, or Firm* — Suiter Swantz pc llo

(57) ABSTRACT

The invention relates to a system for actively damping a ship's motion, comprising at least one first rotatable stabilization element extending from the ship's hull, below the water line, on a side of the ship, sensor means for sensing the ship's motion and delivering control signals on the basis thereof to driving means for rotatably driving the stabilization element for the purpose of damping the ship's motion being sensed, as well as moving means for moving the stabilization element relative to the ship. According to the invention, the active stabilization system is to that end characterized in that the moving means are configured to impart a precession motion to the at least one rotatable stabilization element in dependence on the ship's sailing speed and the control signals being delivered by the sensor means. Imparting a precession movement to the rotating stabilization elements obviates the need to constantly change the direction of the mass of the stabilization elements.
(Continued)

Instead, only the direction of rotation of the stabilization elements needs to be constantly reversed and adjusted for speed.

10 Claims, 11 Drawing Sheets

(58) Field of Classification Search
USPC ..... 114/126
See application file for complete search history.

(56) References Cited

U.S. PATENT DOCUMENTS

| | | | | |
|---|---|---|---|---|
| 3,934,534 | A * | 1/1976 | Larsh | B63B 39/06 114/122 |
| 6,880,478 | B2 * | 4/2005 | Schmitz, Sr. | B63B 39/06 114/162 |
| 6,978,728 | B2 * | 12/2005 | Koop | B63B 39/06 114/126 |
| 9,227,705 | B2 * | 1/2016 | Van Aken | B63B 39/06 |

FOREIGN PATENT DOCUMENTS

| | | | |
|---|---|---|---|
| GB | 2508400 | A | 6/2014 |
| NL | 8303303 | A | 4/1985 |
| NL | 1023921 | C2 | 1/2005 |

* cited by examiner

ACTIVE ROLL STABILISATION SYSTEM FOR DAMPING A SHIP'S MOTION

TECHNICAL FIELD

The invention relates to a device for actively damping a ship's motion, comprising at least one first rotatable stabilisation element extending on a side and below the water line of the ship, sensor means for sensing the ship's motion and on the basis thereof delivering control signals to driving means for rotatably driving the stabilisation element for the purpose of damping the sensed ship's motion, as well as moving means for moving the stabilisation element relative to the ship.

BACKGROUND

Such an active stabilisation system for damping a ship's motion is known, for example from NL patent No. 1023921. In said patent specification it is proposed to configure a stabilisation element that projects into the water from the ship's hull below the water line as a cylindrical stabilisation element. This cylindrical stabilisation element is rotated about its longitudinal axis so as to compensate for the roll of the ship while it is stationary. To that end, the ship is fitted with sensor means, for example angle sensors, speed sensors and acceleration sensors, by means of which the angle, the rate or the acceleration of the ship's roll are sensed. Control signals are generated on the basis of the data being obtained, which signals control the rotation of the rotatable stabilisation element as regards the direction of rotation and the speed of rotation and also the movement of the stabilisation element relative to the ship.

Under the influence of the rotational movement of the stabilisation element and the water flowing past as a result of the stabilisation element moving relative to the stationary ship, a correction force is generated perpendicular to the direction of rotation and the direction of movement. This physical phenomenon is also referred to as the Magnus effect, on the basis of which the correction force is used for opposing the ship's roll. This Magnus effect-based stabilisation system comprising rotating cylindrical stabilisation elements provides a very large correction force already at very low sailing speeds, which force is used as a lifting force for opposing the roll.

This is an ideal solution in the case of ships sailing at low speeds of around 3-4 knots. The stabilisation system is primarily used with stationary ships, however, wherein the rotating stabilisation elements move in a reciprocating translational fashion relative to the ship's hull, and wherein use is made of the relative velocity of the water that flows past the translating stabilisation elements for realising the correcting Magnus effect.

A drawback of the stabilisation system described in said patent is that a reciprocating translational movement relative to the ship's hull is imparted to the stabilisation elements by the moving means. This means that the moving means constantly need to be changed over for accelerating and decelerating the mass of the rotating stabilisation element in one direction of translation and accelerating and decelerating the mass of the rotating stabilisation element in the other, opposite direction of translation. The mass inertia of the system further has an adverse effect on the smooth functioning of the system because also the direction of rotation of the stabilisation elements must be reversed each time by actuating the driving means.

This mass acceleration-deceleration makes considerable demands on the energy sources aboard the ship in question. The generators of the moving means or driving means are loaded heavily and, because of the required change-overs, in a constantly varying manner. This variation is offset as much as possible by using accumulators (in the case of hydraulic drive) for smoothing the peak currents.

SUMMARY

The object of the invention is therefore to provide an active stabilisation system for damping a ship's motion as described in the introduction. According to the invention, the active stabilisation system is to that end characterised in that the moving means are configured to impart a precession motion to the at least one rotatable stabilisation element in dependence on the ship's sailing speed and the control signals being delivered by the sensor means.

The constructional drawbacks of the known stabilisation systems are thus obviated. Imparting a precession movement to the stabilisation elements obviates the need to constantly change the direction of the mass of the stabilisation elements. Instead, only the direction of rotation of the stabilisation elements needs to be constantly reversed and adjusted for speed. This displacement of mass is significantly smaller, so that the entire drive system (driving means and moving means) can be of simpler design.

Another advantage of the precession movement is that the entire mechanical structure constantly rotates in one direction of precession, whilst also the correction lift realised by the Magnus effect can be utilised for a much longer duration for the compensation of the roll movement.

In order to have the stabilisation system according to the invention function optimally, the direction of the precession movement is opposite to the direction of rotation of the at least one rotatable stabilisation element. As a result, an effective compensation of the roll movement is realised. It is noted, however, that the precession and rotation directions and also the precession and rotational speeds can be set independently by the moving means and the driving means, respectively, in dependence on a desired effective damping of the ship's roll.

In another embodiment of the stabilisation system according to the invention, the moving means are configured for setting the precession angle of the at least one rotatable stabilisation element relative to the ship's hull. The compensation of the roll behaviour can thus be effectively set in dependence on the roll behaviour of the ship in question.

According to another embodiment, the stabilisation element is according to the invention connected to the ship by means of a universal joint, so that a precession movement relative to the ship and through the water can be imparted to the rotating stabilisation element in an effective manner.

In a specific embodiment of the aspect of the invention, the stabilisation element can be accommodated in a recess formed in the ship's hull, so that the stabilisation element can be moved back into the ship's hull when the ship is in motion, if desired, so that the friction between the ship in motion and the water will decrease significantly.

The stabilisation element may optionally be accommodated in a guide formed in or on the ship's hull, which guide preferably extends at last in part in the longitudinal direction of the ship.

In a specific embodiment of a stabilisation system according to the invention, the at least one rotatable stabilisation element can only rotate in one direction.

According to another functional embodiment, the at least one rotatable stabilisation element has a cylindrical shape, whilst in another functional embodiment the at least one rotatable stabilisation element has a wing shape.

According to another functional embodiment, stabilisation elements may be provided on either longitudinal side of the ship or only on one side, whilst in another embodiment two or more stabilisation elements are provided at the front side of the ship.

BRIEF DESCRIPTION OF THE DRAWINGS

The invention will now be explained in more detail with reference to a drawing, in which.

DETAILED DESCRIPTION

Figure 1:
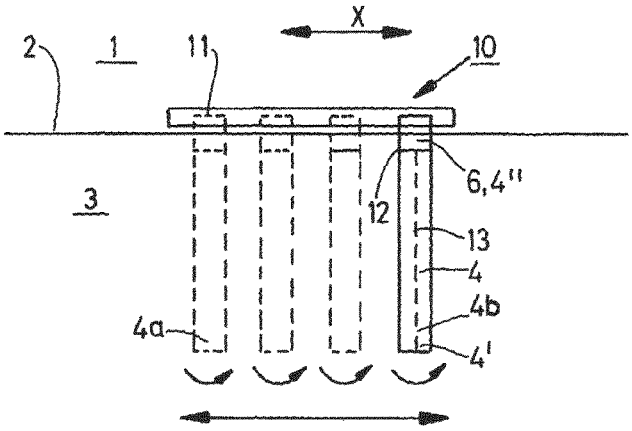
FIGS. 1-4 are views of active roll stabilisation systems according to the prior art.

In FIGS. 1-4 embodiments of active roll stabilisation systems according to the prior art are shown. The stationary ship 1 floating on a water surface 3 is provided with an active roll stabilisation system indicated by reference numerals 10-11-20-10'-20'. This known active roll stabilisation system for a ship's motion as described in Dutch patent No. 1023921 is made up of rotatable stabilisation elements 4*a* and 4*b*, respectively, which each extend from a respective longitudinal side of the hull 2 of the ship below the water line.

The prior art active roll stabilisation system also comprises sensor means (not shown) for sensing the ship's motion, more in particular the ship's roll. On the basis of the sensing results, control signals are delivered to driving means (likewise not shown), which rotatably drive either one of the stabilisation elements 4*a* or 4*b* (depending on the required correction). Said sensor means may consist of angle sensors, speed sensors or acceleration sensors, which continuously sense the angle of the ship relative to the horizontal water surface 3 and the speed or the acceleration caused by the ship's rolls.

FIG. 1 shows an embodiment of a known active stabilisation system provided with a set of rotatable stabilisation elements. The active stabilisation system comprises moving means which move the rotatable stabilisation element 4 with respect to the stationary ship. More particularly, FIG. 1 shows an embodiment in which the moving means 10 impart a reciprocating translational movement between two extreme positions 4*a* and 4*b* to the stabilisation element, such that said movement has at least one component in the longitudinal direction of the ship. The longitudinal direction of the ship is indicated by the wide arrow X in FIG. 1.

In the case of the translating embodiment of the active stabilisation system shown in FIG. 1 (see also FIG. 2), the translational movement of the rotatable stabilisation element 4 is made possible in that a guide 11 forms part of the hull 2 of the ship 1, along which guide the stabilisation element 4 can move. The rotatable stabilisation element 4 is for that purpose accommodated in the guide 11 with its one end 4' via a universal joint 12, so that translational movement in the guide 11 on the one hand and rotational movement about the longitudinal axis 13 on the other hand are possible.

Although this is shown schematically, the rotatable stabilisation element 4 is connected to the driving means 6 by means of a universal joint 12, which driving means rotatably drive the stabilisation element 4 for the purpose of damping the ship's motion that is being sensed. In this embodiment, the assembly of the driving means 6 and the universal joint 12 (which enables the stabilisation element 4 to rotate with respect to the driving means 6 and the ship 1) can translate along the guide 11, for example by means of a rack-and-pinion transmission mechanism (not shown).

Also other translating transmission mechanisms can be used for this purpose, however.

The reciprocating translational movement of the rotatable stabilisation element 4 between the extreme positions 4*a* and 4*b* in the guide 11 in the longitudinal direction X of the stationary ship 1 combined with the rotational movement of the stabilisation element 4 results in a reactive force, also referred to as the Magnus force. This force is perpendicular both to the direction of movement of the stabilisation element 4 in the X-direction and to the direction of rotation.

Depending on the direction of the ship's motion (the ship's roll) to be damped, the direction of rotation of the stabilisation element 4 must be selected so that the resulting Magnus force $F_M$ will oppose the rolling force $F_R$ being exerted on the ship by the ship's roll.

Figure 2:
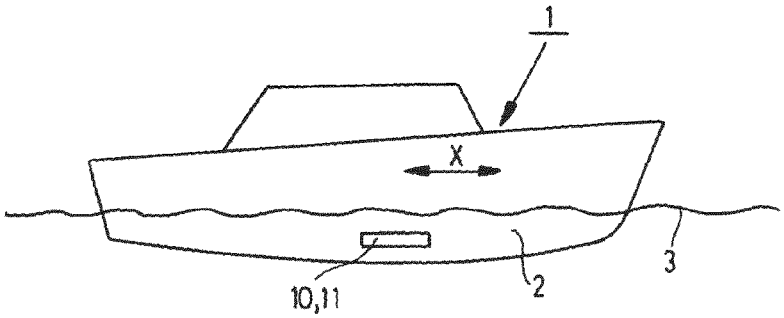
Figure 3:
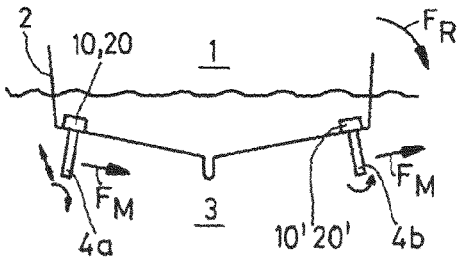

This is shown in FIG. 3, in which the translating rotatable stabilisation elements 4*a*-4*b* are disposed below the water line 3, near the centre of the ship (see FIG. 2). The direction, the speed as well as the acceleration of the roll can be sensed in a manner which is known per se, using suitable sensor means (angle sensor, speed sensor and acceleration sensor). On the basis thereof, control signals are delivered to the respective driving means 6 and 10. On the basis of said signals, the driving means 6 will drive the stabilisation element 4 at a speed and in a direction which may or may not be varied, whilst also the moving means 10 will move the rotating stabilisation element 4 in the longitudinal direction X in the guide 10 at a certain speed.

Figure 4:
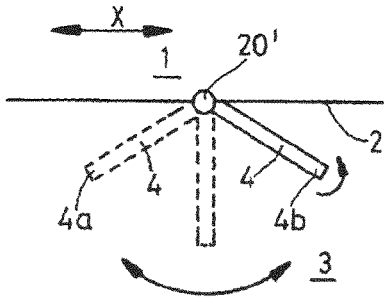

In FIG. 4 another embodiment of a known active stabilisation system is shown, in which the moving means (indicated at 20 here) impart a reciprocating pivoting movement between two extreme positions 4*a* and 4*b* with respect to the stationary ship 1 to the stabilisation element 4. In order to ensure the correct functioning of the active stabilisation system in the case of stationary ships, it is desirable, also in the embodiment shown in FIG. 4, that the pivoting movement imparted to the rotatable stabilisation element 4 by the moving means 20 should have at least one motion component in the longitudinal direction X of the ship 1.

In the above setup, using a suitable control and drive of the stabilisation element 4 in terms of speed and direction of rotation and speed and pivoting direction, the Magnus effect in the case of a stationary ship being at anchor will for example result in a Magnus force $F_M$ having at least one force component directed toward or away from the water surface 3. Said upward or downward force component of the Magnus force $F_M$ can be utilised very effectively for compensating the roll of the stationary ship about its longitudinal axis X.

A major drawback of the currently known active stabilisation systems that function on the basis of the Magnus effect is that at present they can only be used with stationary ships and ships sailing at a very low speed. At present no stabilisation device on the basis of the Magnus effect is available which can be used with ships that sail at a high speed. In addition to that, a higher frictional resistance is experienced during sailing, which renders the known systems unsuitable.

A major drawback of the known active stabilisation systems that function on the basis of the Magnus effect is that at present they can only be used with stationary ships and ships sailing at very low speed. To date no Magnus effect-based stabilisation system is available that can be used with ships sailing at high speed. Add to that the fact that in motion a higher frictional resistance is experienced, which renders the known systems unsuitable.

Figure 5A:
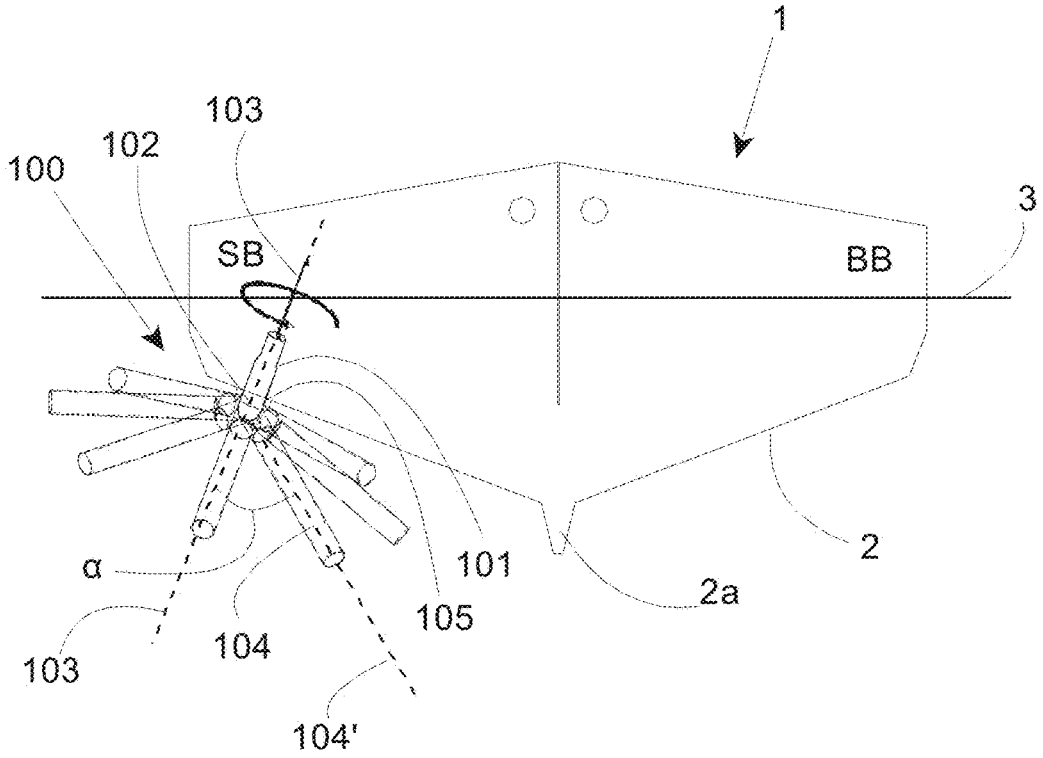
FIG. 5*a* is a front view of a vessel provided with an embodiment of an active stabilisation system according to the invention.

FIG. 5*a* shows a front view of a vessel 1 provided with a first embodiment of a system 100 for actively damping a ship's motion. In this FIG. 5*a*, the vessel 1 is provided with the letter combinations BB and SB, indicating the port side and the starboard side, respectively, of the vessel. In this case, too, the vessel 1 floats on a water surface and numeral 2 indicates the ship's hull under the water surface, whilst 2*a* indicates the keel.

The device 100 is in part accommodated in the hull 2 of the vessel 1, and on the other hand it comprises a rotatable stabilisation element 104 that extends from the ship's hull 2 into the water via an opening 2*b* (see FIGS. 6*a*-6*c* and 8*a*-8*b*). In this embodiment, the stabilisation element 104 is embodied as a rotatable cylinder which extends from the ship's hull 2 on a longitudinal side of the ship, in this figure the starboard side SB, under the water line 3. The rotatable stabilisation element 104 embodied as a cylinder is connected to the ship by means of a universal joint 102, more in particular it is connected to moving means 101.

The moving means 101 are configured to drive the universal joint 102 about the precession axis 103, so that a precession movement about the precession axis 103 relative to the ship's hull is imparted to the stabilisation element 104. The cylindrical stabilisation element 104 is connected to the universal joint 102 at an adjustable angle α, so that the stabilisation element 104 will make a precession movement as a result of the rotational movement about the axis 103 imparted to the universal joint 102 by the moving means 101, as shown in FIG. 5*a*.

Figure 5B:
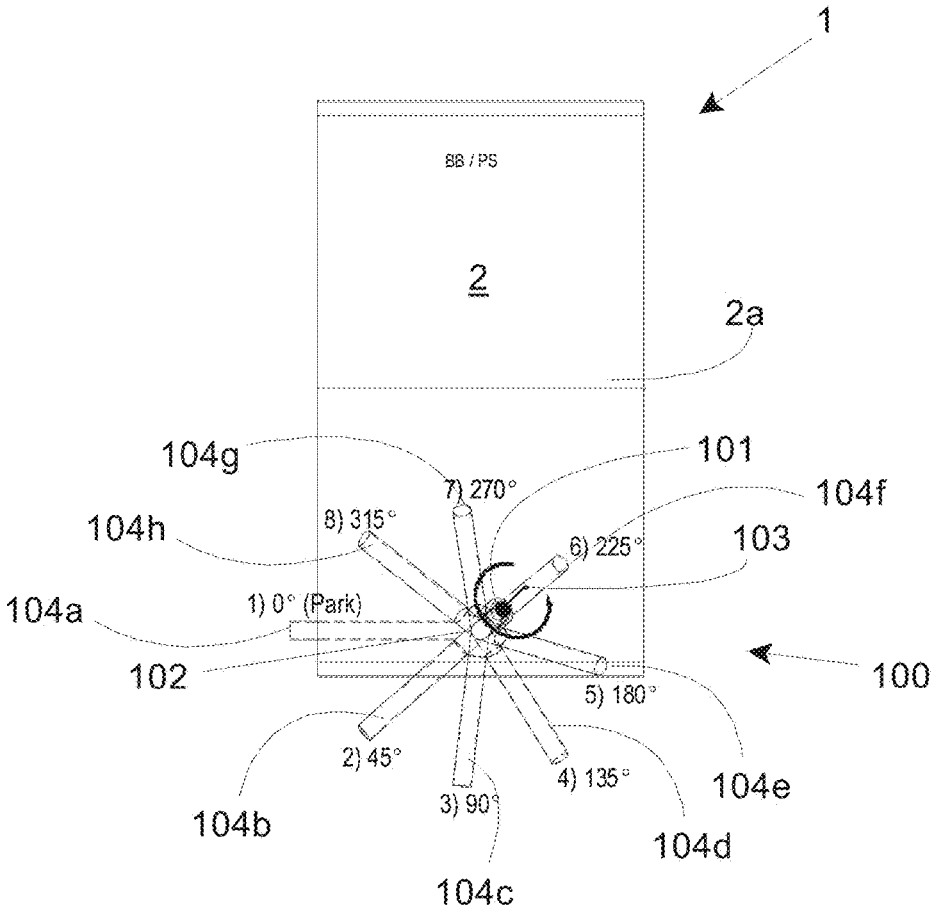
FIG. 5*b* is a top view of the vessel provided with the active stabilisation system of FIG. 5*a* at a speed=0 knots.

FIG. 5*b*, which is a top view of the vessel 1, shows the precession movement of the rotatable stabilisation element 104 about the axis 103 at various angular momentums (positions). In FIG. 5*b*, the precession movement is shown at various rotational positions of 45° each as indicated by numerals 104*a*-104*h*. The stabilisation element 104 that can be precession-driven about the axis 103 can furthermore be rotatably driven about its longitudinal axis 104' by driving means 105 that form part of the active stabilisation system 100.

The system for actively damping a ship's motion by means of a rotatably drivable stabilisation element to which a precession movement is imparted can be used with stationary ships as well as with ships sailing at low speed.

In the case of a stationary ship and a non-operative active stabilisation system according to the invention, the stabilisation element 104 is parked in the 0° position, as indicated at 104*a* in FIG. 5*b*. In this parked position, the stabilisation element 104 has been rotated by means of the universal joint 102 and placed against the ship's hull 2, extending in the direction of the stern (on the left in FIG. 5*b*, the stem of the vessel 1 is shown on the right in FIG. 5*b*).

Optionally a recess (not shown) may be provided in the ship's hull 2, so that the stabilisation element 104 can be accommodated in said recess in its 0° parked position (indicated at 104*a*). The recess is optional, however, as it requires a more complex adaptation of the ship's hull 2.

A stationary ship will undergo a reciprocating rolling movement (from port to starboard and vice versa) under the influence of the swell. To dampen this rolling movement, the stabilisation element 104 is rotated about the precession axis 103 from its 0° parked position to the rotation position 104*e* by the moving means 101, which rotation position corresponds to a half (180°) precession rotation. Because the stabilisation element 104 is not in line with the axis 103 but, by contrast, includes an angle α with said axis 103, the stabilisation element 104 will undergo a precession movement upon rotation of the axis 103 by the moving means 101.

The angle α that the stabilisation element 104 includes with the rotation axis 103 can be set by the universal joint 102 in dependence on the required stabilisation of the ship's 1 roll. During the precession movement imparted to the axis 103, the stabilisation element 104 also rotates about its own longitudinal axis 104' (see FIG. 5*a*). This rotational movement about the stabilisation element's own axis 104' is imparted by driving means 105 that form part of the active stabilisation system 100.

The number of revolutions or rotational speed of the rotatable stabilisation element 104 about its longitudinal rotation axis 104' is set by the driving means 105 in dependence on the sailing speed of the ship and control signals delivered by sensor means of the active stabilisation system 100, which sensor means sense the roll of the ship 1 (direction, speed of roll and acceleration of roll).

The precession movement of the stabilisation element 104 about the precession axis 103 is likewise set by the moving means 101 in dependence on the sailing speed of the ship and control signals delivered by sensor means of the active stabilisation system 100, which sensor means sense the rolling movements of the ship 1 (direction, speed of roll and acceleration of roll).

In this embodiment the starting point is a stationary vessel in port. On the basis of the control signals being delivered, the moving means 101 generate the rotational speed of the stabilisation element 104 about its rotation axis 104'.

As a result of the precession movement of the stabilisation element 104 about the precession axis 103 and the rotational movement of the stabilisation element 104 about its rotation axis 104', a correction force is generated, as already described before herein, which correction force is perpendicular to the direction of rotation of the stabilisation element 104 and also perpendicular to the direction of precession about the precession axis 103. A correction force or lift generated on the basis of this Magnus effect will act in the opposite direction of the angular displacement of the ship during the ship's roll, for example from starboard SB to port BB.

The lift or correction force (Magnus force) thus generated continuously opposes this angular displacement, because this Magnus force has at least one force component directed toward or away from the water level 3. This upward or downward force component of the Magnus force can be used very effectively for compensating the roll of the stationary ship 1 about its longitudinal axis.

The moment the ship's rolling movement from starboard SB to port BB has ended and the ship undergoes a rolling movement from port BB to starboard SB, the precession movement of the stabilisation element 104 is continued from the position indicated at 104*e* in FIG. 5*b*, via the positions 104*f*-104*g*-104*h*, to the starting position 104*a*, which corresponds to the 0° (=360°) precession rotation.

The precession movement of the stabilisation element 104 about the precession axis 103 is therefore a continuous movement from the starting position 104*a*, via the positions 104*b*-104*c*-104*d*, in the direction of the intermediate position 104*e* (corresponding to the 180° precession movement) and further back to the starting position 104*a* via 104*f*-104*g*-104*h*. The precession speed, being the rotational speed about the precession axis 103, is constant and adapted to the frequency of the ship's roll about its longitudinal axis from starboard SB to port BB, and vice versa.

Depending on the direction of the roll to be damped, also the direction of rotation of the stabilisation element 104 about its rotation axis 104' must be selected so that the resulting Magnus force $F_M$ (see FIG. 3) will oppose the rolling force exerted on the ship by the rolling movement. Thus, the direction of rotation of the stabilisation element 104*e* (corresponding to 180° or, in other words, half a precession movement) must be reversed for the reverse rolling movement of the ship 1 from its extreme end on the port side BB in the direction of the starboard side SB. This direction of rotation is thus opposite to the direction of rotation of the stabilisation element 104 during the first half stroke of the precession movement from the position 104, via the positions 104*b*-104*c*-104*d*, to the 180° position 104*e*. In this position 104*e*, the direction of rotation of the stabilisation element 104 about its rotation axis 104' is reversed, therefore, so that during the second half precession movement to the end position 104*a* via the positions 104*f*-104*g*-104*h* the thus generated Magnus force will oppose the ship's rolling movement from the port side BB to the starboard side SB.

Imparting a precession movement to the stabilisation elements 104 obviates the need to cause the mass of the stabilisation elements to change direction constantly. Instead thereof, only the direction of rotation of the stabilisation elements and their rotational speed needs to be constantly changed/adjusted. This displacement of mass is significantly smaller, so that the entire drive system (driving means 105 and moving means 101) can be of simpler design.

By further making the rotatable stabilisation element of a lightweight material, such as carbon fibre, a significant weight-saving and mass inertia reduction can be effected, so that the entire drive system of the active roll stabilisation system can be of simpler design.

Figure 5C:
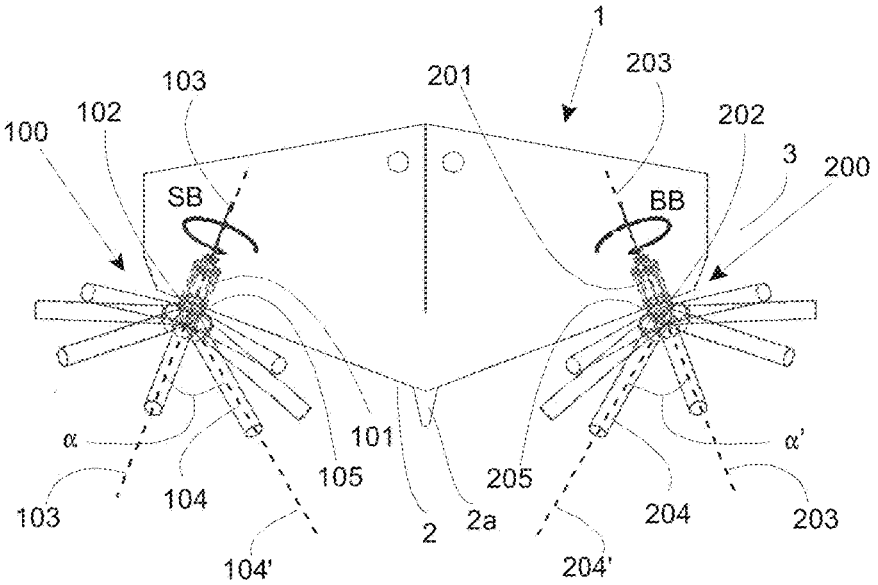
FIG. 5*c* is a front view of the vessel of FIG. 5*a* provided with two embodiments of an active stabilisation system according to the invention.

Although in FIG. 5*a* a roll stabilisation system 100 according to the invention is only shown on the starboard side SB for the sake of simplicity, every ship 1 is preferably equipped with two stabilisation systems according to the invention disposed on the port side BB and the starboard side SB, respectively. This usual embodiment is shown in FIG. 5*c*, in which the stabilisation system according to the invention provided on the port side BB is indicated at 200. The stabilisation element 204 rotating about its rotation axis 204' and precessing about its precession axis 203 is driven in an identical manner by this active stabilisation system 200, but such that the force being generated (Magnus force) is of opposite sense.

This means that during the rolling movement about the longitudinal axis of the ship 1 from port BB to starboard SB, the active stabilisation system 100 comprising the rotating and precessing stabilisation element 104, which is disposed on the starboard side SB, will oppose the downward movement of the starboard side SB. At the same time, the active stabilisation system 200 comprising the rotating and precessing stabilisation element 204, which is disposed on the port side, will generate a similar correction force, which force opposes the upward movement of the port side BB of the vessel.

With this arrangement of an active stabilisation system provided both on the port side BB and on the starboard side SB and a suitable control and drive of the two stabilisation elements 104 and 204, respectively, in terms of direction and speed of rotation about their respective axes of rotation 104' and 204' and a set angle $\alpha$ and $\alpha'$, respectively, between the rotation axis 104'/204' and the precession axis 103'/203' as well as a precession direction and speed about their respective precession axes 103 and 203, the Magnus effect that occurs at each stabilisation element 104 and 204, respectively, of a stationary ship 1 at anchor can result in a Magnus force having at least one force component that is directed toward or away from the water level 3. This upward or downward force component of the Magnus force can be utilised very effectively for compensating the roll of the stationary ship 1 about its longitudinal axis.

Figure 6A:
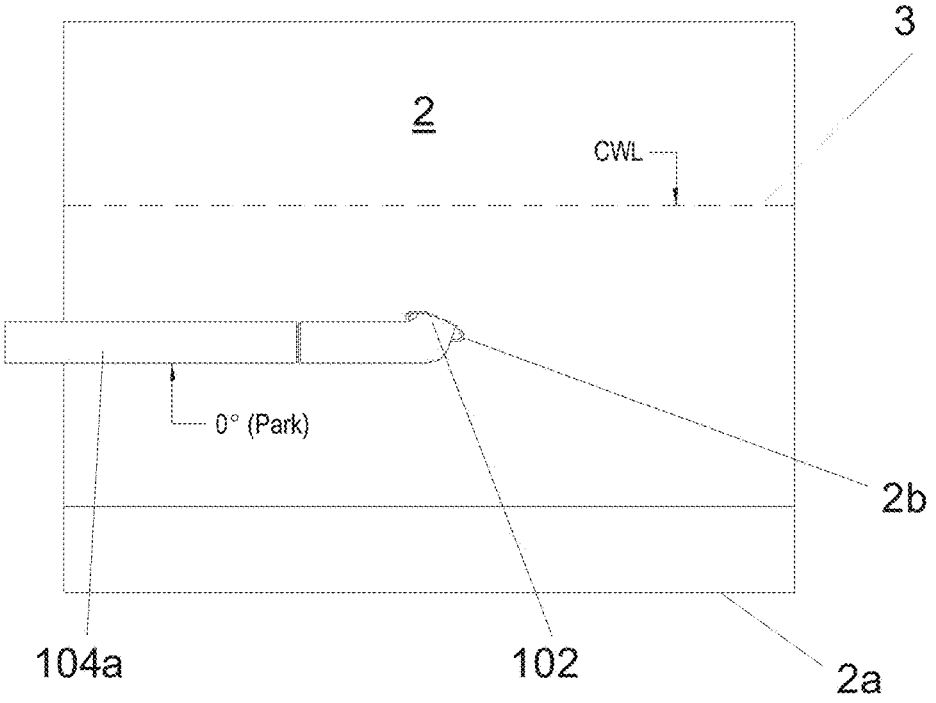
FIGS. 6*a*-6*c* are views showing various operating situations of the active stabilisation system of FIGS. 5*a* and 5*b* at a speed>0 knots.
Figure 6B:
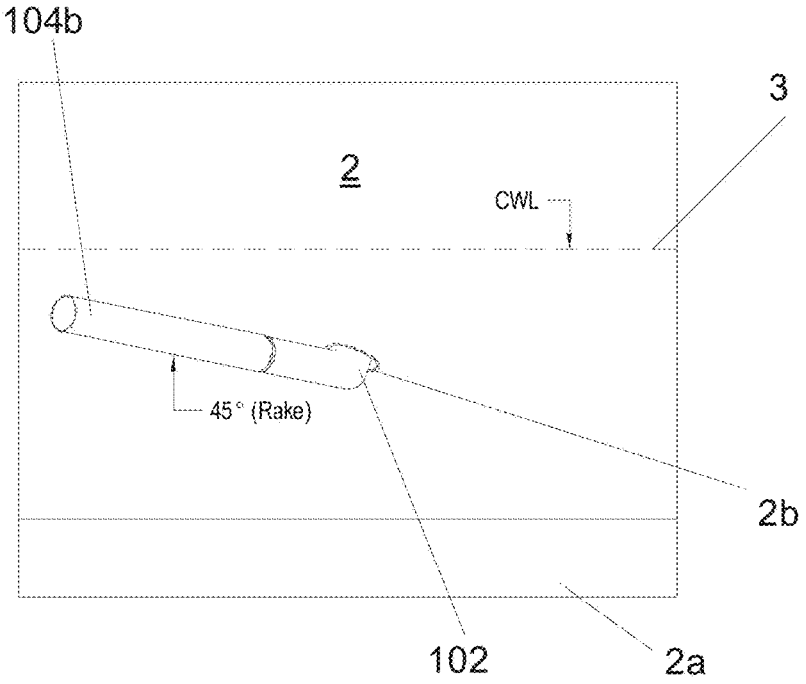
Figure 6C:
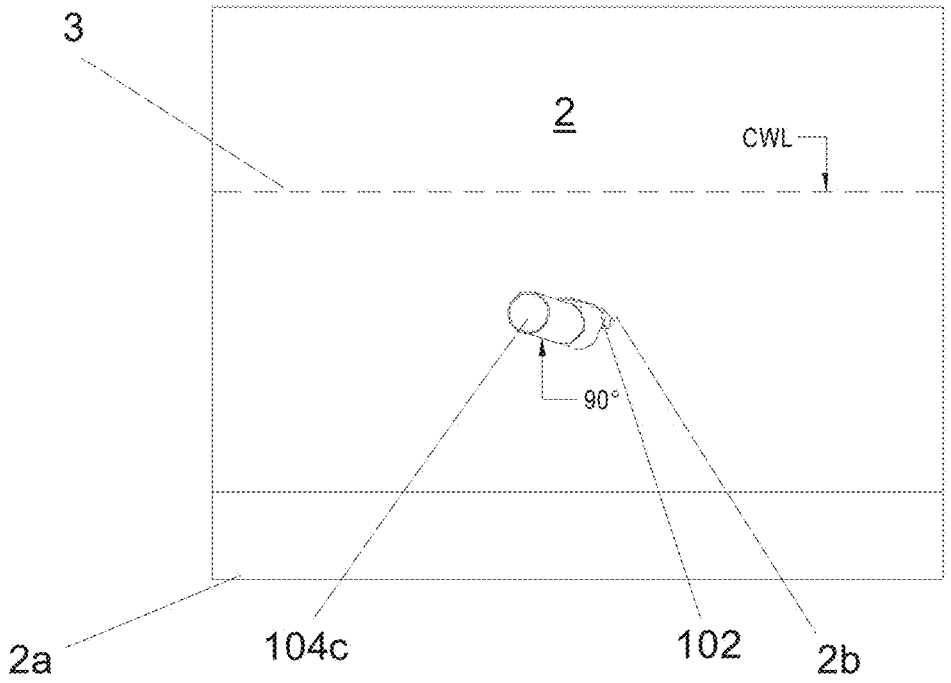

FIGS. 6*a*-6*b*-6*c* show the embodiment of the active roll stabilisation system that is also shown in FIGS. 5*a*-5*c*. According to the invention, a rotational movement about the longitudinal rotation axis 104' as well as a precession movement about the precession axis 103 can be imparted to the stabilisation element 104 by the driving means 105 and the moving means 101, respectively, wherein the direction and speed of the two movements are set in dependence on the sailing speed (and direction) of the ship and control signals generated by sensor means that sense the movements of the ship 1 (roll about its longitudinal axis).

The embodiment as shown in FIGS. 5*a*-5*b*-5*c* has been explained on the basis of the situation in which the ship is stationary (sailing speed is 0 knots).

However, the active roll stabilisation system according to the invention can also be used very effectively with ships in motion. This embodiment of the active roll stabilisation system is shown in FIGS. 6*a*-6*c*. In this case, too, the starting point is the situation of the active roll stabilisation system in which the stabilisation element 104 is in its starting position or parked position as shown in FIG. 6*a*. The stabilisation element 104 has to that end been rotated about its precession axis 103 by means of the moving means 101 (see FIG. 5*a*) and the universal joint 102, such that it extends parallel to the ship's hull 2 in the direction of of the stern of the ship 1. The stabilisation element 104 is in the 0° position (the starting position as indicated at 104*a*) in that situation.

In the following explanation of this embodiment of the active roll stabilisation system according to the invention it is assumed that the ship 1 moves from the left to the right in FIGS. 6*a*-6*b*-6*c*. In the 0° position, the resistance experienced by the ship 1 while in motion (from the left to the right in the figures) is minimal. At a certain sailing speed, the active roll stabilisation system can be actively employed for damping the ship's roll while the ship is in motion. The stabilisation element 104 is to that end rotated about its precession axis 103 from its 0° position 104*a* to a fixed precession angle of, for example, 45°. This precession position is shown in FIG. 6*b* and corresponds to the intermediate position 104*c* shown in FIG. 5*b*.

At this roll stabilisation activity, a fixed precession angle (in this case 45°) is imparted to the stabilisation element 104 in dependence on the sailing speed. As in the case of a ship in motion the stabilisation element is set to a fixed precession angle relative to the ship's hull 2 in dependence on the ship's speed and roll and is also rotated about its own longitudinal rotation axis 104', a Magnus force is generated in a similar manner as in the case of a stationary ship, resulting in a lifting force that has a component toward or away from the water level 3, depending on the direction of the rolling movement.

Whilst in the embodiment shown in FIGS. 5*a*-5*c* the Magnus effect is generated both by the rotational movement and the precession movement of the stabilisation element 104 in the case of a stationary ship (where the stabilisation element 104 is moved by a stationary water mass), in the case of a ship in motion the Magnus effect is generated by the rotating stabilisation element 104 (which is stationary relative to the ship's hull, however) and the water mass flowing past as a result of the ship being in motion.

In the embodiment shown in FIG. 6*b*, in which the stabilisation element 104 takes up a fixed precession angle of 45° relative to the ship's hull 2, the frictional resistance experienced by a ship in motion is higher, to be true, but the correction effect on the ship's movement is effective at all times. In the embodiment shown in FIG. 6*b*, the stabilisation element is set at a fixed precession angle of 90° (corresponding to the position 104*c* in FIG. 5 bravo), and the stabilisation element 104 extends more or less perpendicular to the ship's hull. Although this means that the frictional resistance caused by the water flowing past is maximal, the Magnus force generated by the rotating stabilisation element 104 as the correction force for the ship's roll is also maximal.

Experiments have shown that this embodiment can be used effectively with ships sailing at a speed of about 14 knots at most. The effect of such an active stabilisation system, in which the rotating stabilisation element 104 is set at a fixed precession angle relative to the ship's hull 2, is in particular very effective at very low sailing speeds (3 to 4 knots).

The precession angle of the rotatable stabilisation element 104 relative to the longitudinal axis of the ship or the ship's hull 2 is effectively set on the basis of the control signals generated by the sensor means and also delivered to the moving means, which sensor means sense the roll and also the sailing speed of the ship 1. Depending on this, the precession angle of the rotating stabilisation element 104 relative to the ship's hull and the direction of movement of the ship can be adjusted so that on the one hand the resistance experienced from the water flowing past the stabilisation element is minimised and on the other hand the stabilisation of the ship's roll (the effective opposing of the roll) is optimised.

This can be explained in the very first-place on the basis of the projected surface area of the rotating stabilisation element 104, i.e. the surface area of the stabilisation element along which the water is to flow. See FIGS. 7*a*-7*d*. Said projected surface area is greatest when the stabilisation elements extend perpendicularly to the ship's hull and depends on the angle between the stabilisation element and the water flowing past. In addition, resistance is minimised as a result of the angular setting because the section of the stabilisation element along which water flows relative to the direction of movement of the ship is no longer cylindrical but becomes elliptic when such an angular setting is used. As a result, a better "streamline" for the water flowing past is obtained, so that less resistance will be experienced.

In addition to that it has been found that as a result of the ever increasing angle relative to the direction of movement of the ship (see subfigures 7*a*-7*b*-7*c*-7*d*) the area of the elliptic section will likewise increase.

Figure 7:
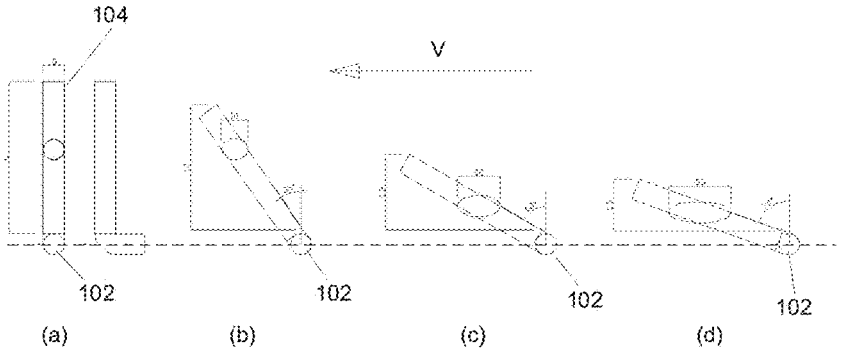
FIGS. 7*a*-7*d* are views showing a stabilisation element of an active stabilisation system according to the invention.
Figure 8:
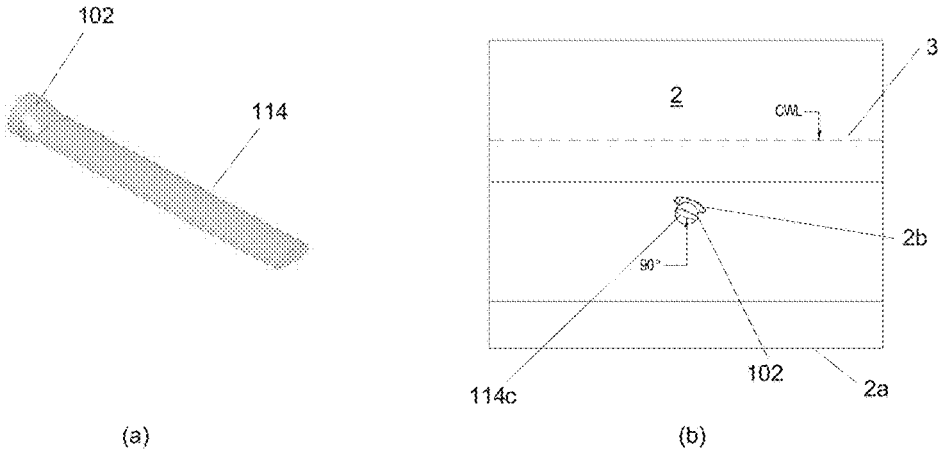
FIGS. 8*a* and 8*b* are views of another embodiment of an active stabilisation system according to the invention.

FIG. 7 shows by way of illustration the surface area increase realised by the elliptic shape as the angle increases. The ratio L/D (the so-called Aspect Ratio, being the relation between the length and the thickness of the stabilisation element) remains identical, but the flow contact area determined by the diameter (or section) D and the projected length L-L1-L2-L3 (see FIGS. 7*a*-7*b*-7*c*-7*d*) of the stabilisation element now set at an angle, and consequently the resistance the stabilisation element experiences from the water, will decrease significantly as the angle is increased from situation 7*a* to situation 7*d*.

Although the effective projected length L-L1-L2-L3 of the stabilisation element decreases as the angle increases, and consequently also the effectiveness of the compensation of the roll movement generated by this rotating stabilisation element, this decrease in the effectiveness of the roll stabilisation is corrected by the increased elliptical section (or diameter) D-D1-D2-D3 of the stabilisation element. Said elliptical section D-D1-D2-D3 that is in contact with the flow, which likewise increases as the angle increases, provides an additional lifting moment for the roll stabilisation, so that the rotating stabilisation element will be able to generate a sufficiently strong Magnus effect for correcting the roll stabilisation also in the case of large angles.

Regarding the above explanation, the angular settings of 45° and 90° relative to the ship's direction of movement V that are shown in FIGS. 5*a*-5*d* are purely intended by way of example for explaining the effect of the enlarged elliptical section on the correction of the roll stabilisation.

The advantage of this stabilisation control is that the stabilisation system can be active at all times, independently of the sailing speed, while the ship is in motion and that the frictional resistance experienced by the stabilisation elements experience is considerably less than the frictional resistance experienced by a prior art stabilisation system, in which the stabilisation elements take up a fixed (perpendicular) position relative to the ship's direction of movement and are thus not constantly adjusted.

In FIGS. 8*a*-8*e* there is shown another embodiment of a stabilisation system according to the invention which has the same stabilisation functionality. In order to further reduce the resistance in the water of the stabilisation element 4, the shape of the element has been adapted in this embodiment. Cylindrical stabilisation elements are no longer used in this embodiment, but (as shown in more detail in FIGS. 9*a*-9*e*) the stabilisation element 114 has a wing shape 142*a* which is connected to a support part 141 of the stabilisation element, which in turn is connected to the universal joint 102 (which is driven by a drive shaft 103 of the driving means 101, see FIG. 5).

Figure 9:
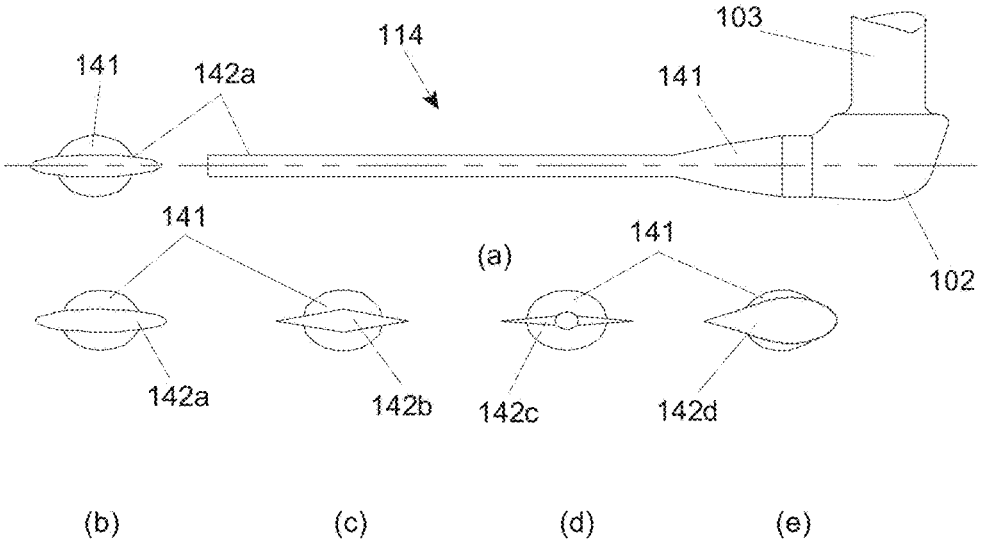
FIGS. 9*a*-9*e* are views showing various embodiments of a stabilisation element of an active stabilisation system according to the invention.

The wing 142 may have an elliptic shape 142*a* (FIGS. 9*a* and 9*b*), a triangular shape 142*b*-142*c* (FIGS. 9*c* and 9*d*, resulting in the so-called Kamm-effect) or a teardrop shape 142*d* (FIG. 9*e*).

The stabilisation system according to the invention is provided with an adaptive control system, wherein the sensor means are designed to determine the current sailing speed. This current sailing speed is compared to a reference sailing speed, which is determined in particular by the design of the ship and its roll behaviour on the water. The control system is designed to generate control signals on the basis of said comparison and deliver them both to the driving means, which set the rotational speed of the stabilisation element, and to the moving means, which arrange the angular setting relative to the ship's direction of movement.

The control system is in particular designed so that if the current sailing speed of the ship is lower than the reference sailing speed, the driving means will drive the stabilisation elements at a rotational speed higher than 0 rpm. Optionally the moving means can set the stabilisation elements at an angle relative to the ship's direction of movement, depending on the desired minimisation of the frictional resistance being experienced from the water.

At high sailing speeds, the rotating stabilisation element experiences too much frictional resistance, which can no longer be minimised by changing the angular setting. The control system according to the invention is therefore set so that if the current sailing speed of the ship is higher than the reference sailing speed (which has been defined on the basis of the design and the roll behaviour of that type of ship), the driving means will drive the stabilisation element at a rotational speed equal to 0 rpm and the moving means will impart a reciprocating pivoting movement to the stabilisation element, which no longer rotates and is in the "feathering" position at that stage.

This additional functionality of the active stabilisation system make it possible to bring about quick and efficient adaptations to changing sailing conditions, so that on the one hand adequate corrections are constantly made for the ship's roll and on the other hand the water resistance of the ship is minimised.

At high sailing speeds the wing profile, where the non-rotating stabilisation element has a profile which generates or experiences only a minimum resistance in the "feathering" position, is clearly advantageous. At low speeds the stabilisation element can be taken out of the "feathering" position by imparting a rotational speed thereto, as a result of which the water mass is converted into a virtual cylinder, so that as a result a Magnus effect sufficiently strong for effecting the roll stabilisation is generated.

Figure 10:
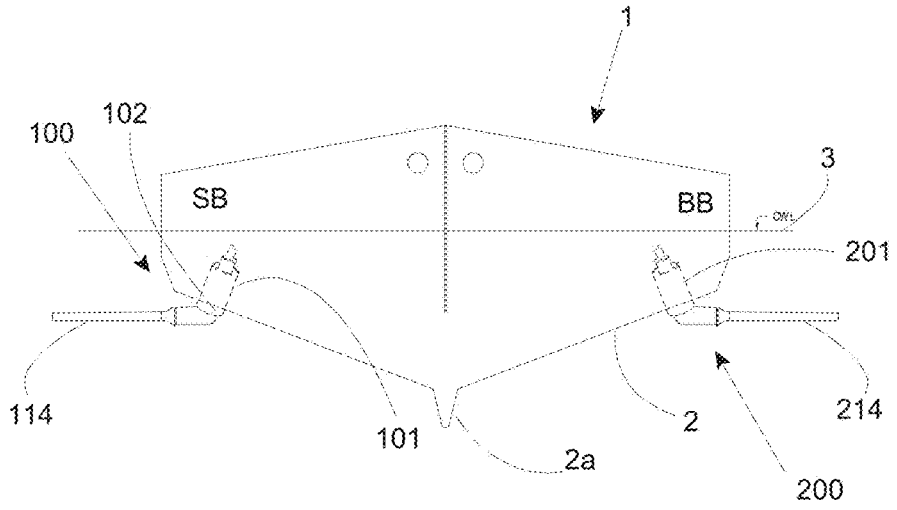
FIG. 10 is a front view of a vessel provided with the active stabilisation system according to FIGS. 8*a* and 8*b*.

The control system is such that at higher speeds the rotation of the stabilisation elements (effected by the driving means) can be automatically converted into a reciprocating pivoting movement (by the moving means) about the rotation axis 104' around the feathering position, so that a lifting effect can be generated from the pivoting angular displacement of the stabilisation element about its rotation axis 104' through, for example, −20° to +20°. The constant adjustment of this pivoting angle is carried out by the electronics of the control system. See FIG. 10, in which two active roll stabilisation systems 100 and 200 are disposed on either side of the vessel, analogously to FIG. 5*c*.

In situations in which the stabilisation system need not be constantly active, the wing-shaped rotating stabilisation element is parked in the feathering position (rotation=0 rpm), so that hardly any resistance is experienced. In the feathering position, the stabilisation element "cuts" through the water without any friction, as it were. See FIG. 8*b*.

The invention claimed is:

1. A system for actively damping a ship's motion, comprising at least one first rotatable stabilisation element extending from the ship's hull, below the water line, on a side of the ship, sensor means for sensing the ship's motion and delivering control signals on the basis thereof, driving means for rotatably driving the stabilisation element on the basis of the control signals being delivered for the purpose of damping the ship's motion being sensed, as well as moving means for moving the stabilisation element relative to the ship on the basis of the control signals being delivered, wherein the moving means are configured to impart a precession motion to the at least one rotatable stabilisation element in dependence on the ship's sailing speed and the control signals being delivered by the sensor means.

2. An active stabilisation system according to claim 1, wherein the direction of the precession movement is opposite to the direction of rotation of the at least one rotatable stabilisation element.

3. An active stabilisation system according to claim 1, wherein the moving means are configured for setting the precession angle of the at least one rotatable stabilisation element relative to the ship's hull.

4. An active stabilisation system according to claim 1, wherein the stabilisation element is connected to the ship by means of a universal joint.

5. An active stabilisation system according to claim 1, wherein the stabilisation element is configured to be accommodated in a recess formed in the ship's hull.

6. An active stabilisation system according to claim 1, wherein the at least one rotatable stabilisation element rotates in only one direction.

7. An active stabilisation system according to claim 1, wherein the at least one rotatable stabilisation element has a cylindrical shape.

8. An active stabilisation system according to claim 1, wherein the at least one rotatable stabilisation element has a wing shape.

9. An active stabilisation system according to claim 1, wherein at least one stabilisation element is provided on each longitudinal side of the ship.

10. An active stabilisation system according to claim 9, wherein the pair of stabilisation elements are provided at a front of the ship.

* * * * *